US008056778B1

(12) United States Patent
Michaux

(10) Patent No.: US 8,056,778 B1
(45) Date of Patent: Nov. 15, 2011

(54) LONG GUN SUPPORT AND METHOD

(75) Inventor: Jerry Alan Michaux, Greensboro, NC (US)

(73) Assignee: Dwayne G. Bingman, Julian, NC (US)

( * ) Notice: Subject to any disclaimer, the term of this patent is extended or adjusted under 35 U.S.C. 154(b) by 417 days.

(21) Appl. No.: 11/998,115

(22) Filed: Nov. 28, 2007

(51) Int. Cl.
*F41C 33/00* (2006.01)
*F41C 33/02* (2006.01)

(52) U.S. Cl. ..... 224/149; 224/150

(58) Field of Classification Search ..... 224/150, 224/149, 913, 192, 193, 238, 243, 907, 911, 224/912
See application file for complete search history.

(56) References Cited

U.S. PATENT DOCUMENTS

| | | | | | |
|---|---|---|---|---|---|
| 476,246 | A | | 6/1892 | Burgess | |
| 1,519,123 | A | * | 12/1924 | Edwards | 2/94 |
| 2,423,531 | A | | 7/1947 | Theis | 224/2 |
| 2,536,252 | A | | 1/1951 | Bates | 224/2 |
| 2,576,559 | A | * | 11/1951 | Bennek | 224/149 |
| 2,647,667 | A | * | 8/1953 | Brown et al. | 224/149 |
| 2,884,172 | A | * | 4/1959 | Kubo | 224/149 |
| 2,915,233 | A | * | 12/1959 | Moomaw | 224/149 |
| 2,948,449 | A | * | 8/1960 | Aronson et al. | 224/149 |
| 3,081,923 | A | * | 3/1963 | Bagby | 224/149 |
| 3,221,958 | A | * | 12/1965 | Straight | 224/149 |
| 3,430,828 | A | * | 3/1969 | Gregson | 224/149 |
| 4,243,165 | A | * | 1/1981 | Schuler | 224/149 |
| 4,493,115 | A | * | 1/1985 | Maier et al. | 2/459 |
| 4,514,862 | A | * | 5/1985 | A'Costa | 2/459 |
| 4,642,815 | A | * | 2/1987 | Allen | 2/459 |
| 4,964,553 | A | * | 10/1990 | Glynn | 224/149 |
| 5,325,618 | A | | 7/1994 | Turner | 42/85 |
| 5,503,316 | A | * | 4/1996 | Stewart | 224/312 |
| 5,629,673 | A | * | 5/1997 | Juhasz | 340/540 |
| 5,927,574 | A | * | 7/1999 | Ruesink | 224/149 |
| 6,823,870 | B1 | * | 11/2004 | Hill et al. | 128/869 |
| 7,506,470 | B2 | * | 3/2009 | Pereksta | 42/94 |
| 2004/0031836 | A1 | * | 2/2004 | Garcia | 224/665 |

* cited by examiner

*Primary Examiner* — Justin Larson
*Assistant Examiner* — Lester L Vanterpool

(57) ABSTRACT

A long gun support for maintaining the stock end of a long gun against the chest of a user. A strap assembly worn by the user includes a pad for attaching to a pliable gun butt sleeve in the chest region where the stock of a long gun stock is conventionally placed for firing.

8 Claims, 2 Drawing Sheets

LONG GUN SUPPORT AND METHOD

FIELD OF THE INVENTION

The invention disclosed herein pertains to hunting and shooting accessories and particularly pertains to a strap assembly for maintaining the butt or stock end of a long gun such as a shotgun against the shoulder of the hunter. A flexible sleeve/support is attachable to the stock end of a long gun. The support is affixed by hook and loop fastener to the strap assembly. With the aid of the support, a hunter in a sitting position on the ground can keep the fore end of a long gun against his legs while maintaining the stock end against his shoulder. This allows the hunter's hands to remain free to operate a game call, for example, or perform other duties while awaiting the approach of game.

DESCRIPTION OF THE PRIOR ART AND OBJECTIVES OF THE INVENTION

Various accessory devices have been developed for supporting a long gun in relation to the body of a shooter. Among these devices are U.S. Pat. No. 4,243,165 which provides a shoulder strap supporting a cup for receiving the butt end of a shotgun stock. The cup provides for consistent placement and alignment of the gun in relation to an optimum shooting position. The cup is a positioning device that receives the butt end of a gun stock.

Another device shown in U.S. Pat. No. 5,325,618 provides a harness having a shoulder strap connected to a torso encircling strap. The shoulder strap includes a folding flap with a fastener for securing the fore end of a long gun vertically oriented with the stock portion supported by a cord. The long gun is released from the folding flap before it can be transferred to a conventional shooting position.

U.S. Pat. No. 476,246 includes spring catches in the stock of a long arm for receiving a stud attached to a harness for retaining the stock in a firing position. The stock of the long arm is modified to retain the stud.

Another patent, U.S. Pat. No. 2,423,531, comprises a gun rest in the form of a hook carried on a back plate mounted on a garment front on the chest of a hunter. The hook supports an upwardly oriented long gun while the stock end is carried in the hunter's shooting hand. The gun must be removed from the hook before the hunter can assume a conventional shooting position.

With the disadvantages of conventional devices known, an objective of the invention disclosed herein is to provide a long gun support and method of use for maintaining the stock end of a long gun on the chest of a shooter where a long gun is conventionally placed for firing while the fore end of the gun rests on a sitting shooter's legs during dormant periods.

Another objective of the present invention is to provide a support device that supports the stock end of a long gun while permitting the gun to be pivoted and rotated.

Yet another objective of the present invention is to provide a long gun support that includes a gunstock-receiving sleeve that can be positioned on the gun stock of a long gun prior to entry into the field, easily attached to a strap assembly after the hunter assumes an ambush position, and easily detaches from the strap assembly after the hunt.

Another objective of the present invention is to provide a support device that can be used with a conventional long gun without modification to the gun.

It is a further objective of the present invention to provide a long gun support that can be used quietly to avoid alerting game of the hunter's presence.

Various other objectives and advantages of the present invention will become apparent to those skilled in the art as a more detailed description is set forth below.

SUMMARY OF THE INVENTION

The aforesaid and other objectives are realized by providing embodiments of a hunting and shooting long gun support for maintaining a long gun in a convenient position for rapid firing. The support device includes a strap assembly for maintaining a long gun butt on the chest region where conventionally mounted for firing. A pliable sleeve removably attachable to the strap assembly receives and retains the stock end of a long gun for support in a particular relation while the fore end of the gun is supported, for example, by the shooter's legs in a sitting position while awaiting the approach of game.

DETAILED DESCRIPTION OF THE PREFERRED EMBODIMENTS AND OPERATION OF THE INVENTION

Figure 1:
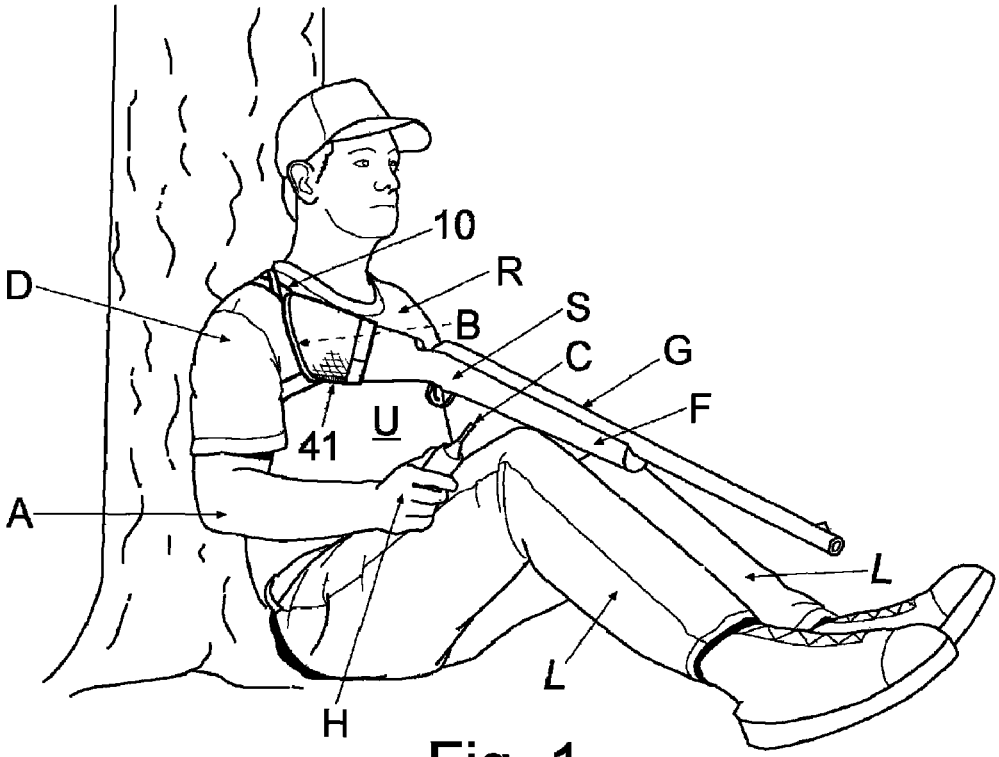
FIG. 1 is a side view of a hunter using an embodiment of the long gun support.

For a better understanding of the invention and its operation, turning now to the drawings, FIG. 1 shows preferred long gun support 10 for maintaining the stock end of a long gun on the chest where a long gun is conventionally placed for firing by user U such as a shooter who is typically a hunter. Long gun support 10 can be used to support stock end B of stock S of long gun G, such as a shotgun, contiguous chest region R while fore end F of gun G is vertically supported by legs L. This allows hunter's hands H free to perform a task aside from supporting long gun G. Free hands H can be used, for example, to operate game call C, while gun G remains supported in nearly a firing position. If the hunter's quarry approaches his shooting range, hunter U can quickly assume a firing position with minimal movement of gun G, which may avoid alerting the quarry.

Figure 2:
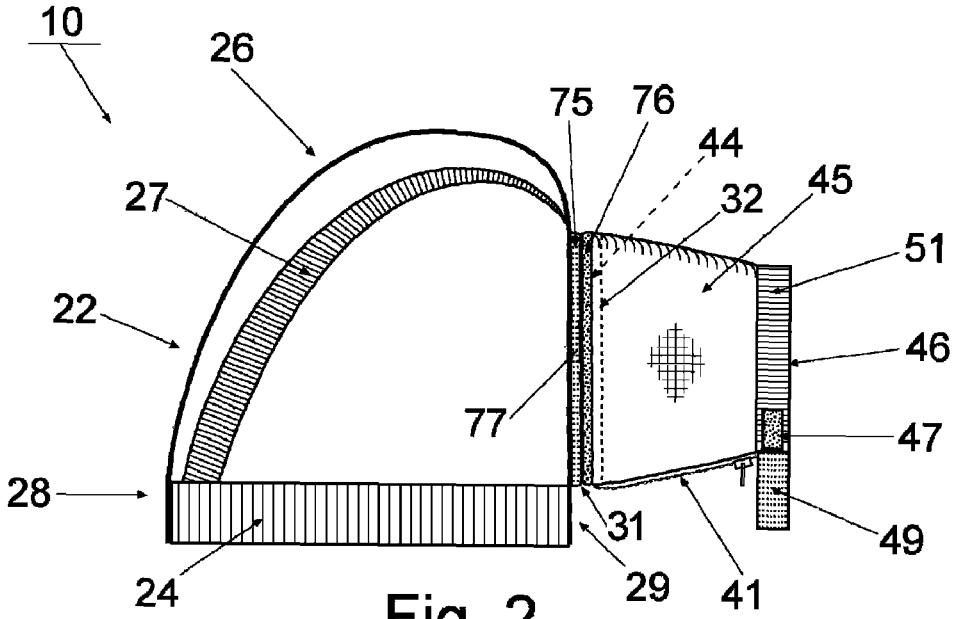
FIG. 2 is a side view of the embodiment of the long gun support as shown in FIG. 1.
Figure 3:
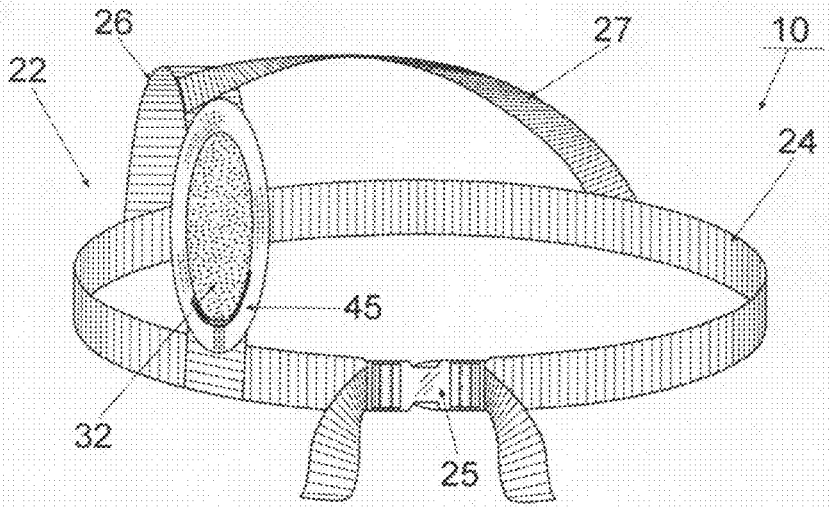
FIG. 3 is a front perspective view of the long gun support seen in FIG. 2.

As shown in FIGS. 2 and 3, with reference again to FIG. 1, long gun support 10 includes strap assembly 22 having an elastic torso strap 24 which forms a loop for encircling upper torso T (FIG. 5) of user U under arms A. Elastic shoulder strap 26 fits over shoulder D and is connected at opposite ends 28 and 29 (FIG. 2) to torso strap 24. An additional support and positioning strap 27 extends over the shoulder D proximate the neck of the user U, and is connected to shoulder strap 26 at the proximal end and to torso strap 24 at the distal end. Strap assembly 22 is adapted to retain resilient mounting pad 75 in a gun firing position in front of chest region R of user U. The position generally corresponds to the area that user U would conventionally mount stock end B of long gun G to discharge a projectile when assuming a firing position.

FIG. 2 also shows gun stock sleeve 45 fully engaged by fastener section 76 to hook and loop section 77 of mounting pad 75. Mounting pad 75 is positioned on shoulder strap 26 and includes hook and loop section 77 as seen in FIG. 2.

Mounting pad 75 and fastener section 76 (FIG. 4) consist of a standard micro-meshing hook-and-loop fastener which can be easily attached and detached. Preferably, sleeve 45 is a tube having closed back end 44 and open front end 46 sized to receive stock end B of long gun G. Preferably, gun stock sleeve 45 is generally constructed of a pliable fabric material and includes a shooting pad 32 at its rear. Fastener 41, which preferably takes the form of a zipper, is provided to open and close gun stock sleeve 45. Buttons, snaps, ties, clamps, hook and loop fasteners may alternately be used to open and close sleeve 45. Band 51, which is formed from an elastic material, is provided for expanding over and retaining stock end B within gun stock sleeve 45 and preferably includes micro-meshing hook 49 and loop 47 surfaces, but could alternatively, or in addition, include any combination of buttons, snaps, ties, clamps or zippers for a similar purpose.

Figure 4:
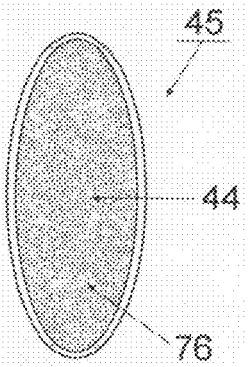
FIG. 4 is a rear view of the sleeve of the long gun support.

FIG. 3 shows strap assembly 22 of long gun support 10 with gun stock sleeve 45 (shown in FIG. 2) affixed thereto having shooting pad 32 therein. Front face 31 (FIG. 2) of mounting pad 75 has affixed thereto hook and loop section 77 extending substantially from the top to the bottom for engagement with fastener section 76 of gun stock sleeve 45. In FIG. 4 hook and loop fastener section 76 of gun stock sleeve 45 likewise extends substantially from the top to the bottom thereof. Also shown, the size of the loop formed by torso strap 24 can be adjusted using mechanism 25, preferably a buckle or slide. Positioning strap 27 is connected to shoulder strap 26 above mounting pad 75 at one end and to torso strap 24 at the distal end to assist in retaining mounting pad 75 in a firing position against the shoulder of user U for firing gun G.

A rear view of gun stock sleeve 45 is shown in FIG. 4 with back end 44 having affixed thereto fastener section 76 for removably connecting back end 44 of sleeve 45 to hook section 77 of mounting pad 75, as shown in FIG. 2. Gun stock sleeve 45 is removably attached to mounting pad 75 by compressive forces applied by pressing together gun stock sleeve 45 to mounting pad 75 so that they remain connected while stock end B of long gun G is carried in gun stock sleeve 45 and its fore end F supported; yet, simply pulling gun stock sleeve 45 from mounting pad 75 applies enough tensile force to separate hook section 77 of mounting pad 75 from fastener section 76 to easily release gun stock sleeve 45 from mounting pad 75. Thus, fastener section 76 permits sleeve 45 to be mounted on a gunstock prior to entry into the field, if desired, and then easily attached to mounting pad 75 quietly once user U assumes a sitting ambush position. For these purposes, micro-meshing hook-and-loop fastener sections are preferred, although any combination of snaps, buttons, ties, clamps, or adhesives could be substituted.

Figure 5:
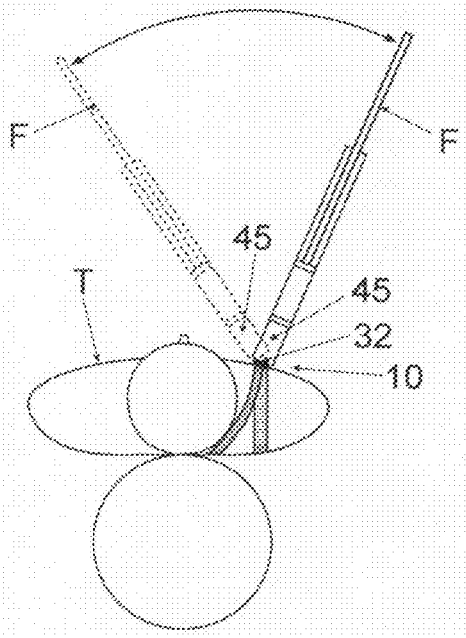
FIG. 5 is a top view depicting a range of gun motion provided by the long gun support.

FIG. 5 shows a top view depicting torso T of user U wearing long gun support 10 and showing a range through which pliable sleeve 45 permits long gun G to be pivoted and rotated slightly for firing with respect to mounting pad 75 while gun stock sleeve 45 maintains attachment to mounting pad 75. This attribute of long gun support 10 permits user U to rest fore end F of gun G across legs L (FIG. 1) and then, when assuming a firing position, point fore end F at his quarry with minimal shoulder or body movement, as sleeve 45 remains attached to mounting pad 75.

With reference to FIGS. 1-5, a preferred method of hunting using long gun support 10 includes inserting the stock end B of a long gun G into the pliable gun stock sleeve 45 and retaining the sleeve 45 on the stock end B by closing fastener 41 and elastic band 51 with hook surface 49 and loop surface 47. The strap assembly 22 can be donned and adjusted as required with strap 27 behind a user's neck to retain the mounting pad 75 on the front chest region R. These steps can be performed prior to entry into the field. After the hunter U assumes a sitting ambush position as seen in FIG. 1, the pliable gun stock sleeve 45 can be fastened to mounting pad 75 where conventionally placed for firing and the fore end F of the long gun G supported by one or both of the hunter's legs L. The hunter U can then observe an area of interest while awaiting the approach of game. After the hunt, the pliable sleeve 45 can be unfastened from mounting pad 75 and the strap assembly 22 removed.

The illustrations and examples provided herein are for explanatory purposes and are not intended to limit the scope of the appended claims.

I claim:

1. A support for a hunter using a long gun to allow easy attachment and detachment comprising:

a strap assembly, said strap assembly comprising a torso strap, an adjusting means, said adjusting means attached to said torso strap;

a shoulder strap, said shoulder strap joined at each end to said torso strap;

a positioning strap, said positioning strap having one end connected to said torso strap and the other end connected to said shoulder strap;

a mounting pad for placement against the hunter's shoulder, said mounting pad comprising a front face and a hook and loop fastener, said mounting pad hook and loop fastener substantially covering said front face of said mounting pad, said mounting pad positioned on said shoulder strap between said positioning strap and said torso strap; and a gun stock sleeve, said gun stock sleeve defining an open front end and a closed rear end, said gun stock sleeve comprising a hook and loop fastener, said gun stock sleeve hook and loop fastener substantially covering said closed rear end, said gun stock sleeve fastener fully engaging said mounting pad fastener for continuous engagement therealong, a shooting pad, said shooting pad contained within said sleeve at said closed rear end whereby said gun stock sleeve can be easily, completely attached to said mounting pad for long gun firing and easily detached thereafter while said mounting pad remains on the hunter's shoulder.

2. The support of claim 1 wherein said shoulder strap is formed from an elastic material.

3. The support of claim 1 wherein said gun stock sleeve comprises a pliable fabric, said shooting pad joined to said pliable fabric.

4. The support of claim 3 wherein said gun stock sleeve further comprises a second fastener, said second fastener extending substantially the length of said gun stock sleeve, and a resilient band, said resilient band attached around said open end of said gun stock sleeve in opposing relation to said shooting pad.

5. The support of claim 4 wherein said resilient band is formed from an elastic material and comprises hook and loop material.

6. A method of supporting a long gun comprising the steps of:

a) providing a strap assembly having a torso strap with an adjusting means, a shoulder strap and a positioning strap, the ends of the shoulder strap each connected in spatial alignment along said torso strap with the positioning strap joined to the torso strap at one end and to the shoulder strap at the other end, a mounting pad with a front face and a hook and loop fastener which completely covers the front face of the mounting pad is joined to the shoulder strap between the positioning strap and the torso strap and a gun stock sleeve having an open front end and a closed rear end, a hook and loop sleeve fastener which substantially covers the closed rear end and a shooting pad positioned in the closed rear end of said gun stock sleeve;

b) donning the strap assembly with the mounting pad positioned on the hunter's shoulder;

c) placing a gun stock in the open end of the gun stock sleeve while the gun stock sleeve is detached from the mounting pad; and d) thereafter attaching the gun stock sleeve hook and loop fastener with the gun stock therein completely to the mounting pad hook and loop fastener for firing purposes.

7. The method of claim 6 further comprising the step of closing a second fastener on the gun stock sleeve around the gun stock.

8. A support for a hunter using a long gun to allow easy attachment and detachment comprising:

a strap assembly, said strap assembly comprising a torso strap, an adjusting means, said adjusting means attached to said torso strap;

a shoulder strap, said shoulder strap joined at each end to said torso strap;

a positioning strap, said positioning strap having one end connected to said torso strap and the other end connected to said shoulder strap;

a mounting pad for placement against the hunter's shoulder, said mounting pad comprising a front face, a fastener, said fastener substantially covering said front face, said mounting pad fastener comprising a hook and loop material, said mounting pad positioned on said shoulder strap between said positioning strap and said torso strap; and a gun stock sleeve, said gun stock sleeve defining an open front end and a closed rear end, said gun stock sleeve comprising a fastener, said gun stock sleeve fastener comprising a hook and loop material, said gun stock sleeve fastener extending to substantially cover said closed rear end of said gun stock sleeve for full, continuous engagement with said mounting pad fastener, a shooting pad, said shooting pad contained within said gun stock sleeve at said closed rear end, said gun stock sleeve fastener releasably, completely joined to said mounting pad fastener whereby said gun stock sleeve can be easily attached to said mounting pad for long gun firing and easily detached thereafter while said mounting pad remains on the hunter's shoulder and the gun stock of the long gun remains in the detached gun stock sleeve.

* * * * *